US010724365B2

(12) United States Patent
Shahri et al.

(10) Patent No.: US 10,724,365 B2
(45) Date of Patent: Jul. 28, 2020

(54) SYSTEM AND METHOD FOR STRESS INVERSION VIA IMAGE LOGS AND FRACTURING DATA

(71) Applicant: Weatherford Technology Holdings, LLC, Houston, TX (US)

(72) Inventors: Mojtaba Pordel Shahri, Houston, TX (US); Ovunc Mutlu, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 1185 days.

(21) Appl. No.: 14/715,880

(22) Filed: May 19, 2015

(65) Prior Publication Data

US 2016/0341849 A1 Nov. 24, 2016

(51) Int. Cl.
*E21B 49/00* (2006.01)

(52) U.S. Cl.
CPC ..... *E21B 49/006* (2013.01)

(58) Field of Classification Search
CPC ..... G01V 1/48; G01V 11/00; G01V 1/40; E21B 49/00
USPC ..... 703/6, 10
See application file for complete search history.

(56) References Cited

U.S. PATENT DOCUMENTS

| | | | |
|---|---|---|---|
| 5,960,371 | A | 9/1999 | Saito et al. |
| 6,041,860 | A | 3/2000 | Nazzal et al. |
| 6,714,480 | B2 | 3/2004 | Sinha et al. |
| 7,042,802 | B2 | 5/2006 | Sinha |
| 7,457,194 | B2 | 11/2008 | Prioul et al. |
| 8,004,932 | B2 | 8/2011 | Zheng et al. |
| 8,117,014 | B2 | 2/2012 | Prioul et al. |
| 8,223,586 | B2 | 7/2012 | Pistre et al. |
| 8,374,836 | B2 | 2/2013 | Yogeswaren |
| 2010/0250214 | A1* | 9/2010 | Prioul ..... G01V 1/48 703/10 |
| 2011/0042080 | A1 | 2/2011 | Birchwood et al. |
| 2012/0150515 | A1 | 6/2012 | Hariharan et al. |
| 2012/0163123 | A1 | 6/2012 | Moos |

(Continued)

FOREIGN PATENT DOCUMENTS

| | | |
|---|---|---|
| EP | 0574237 A2 | 12/1993 |
| GB | 2539592 A | 12/2016 |

(Continued)

OTHER PUBLICATIONS

Xiaochun Jin "Breakdown Determination—A Fracture Mechanics Approach" pp. 1-18.*

(Continued)

*Primary Examiner* — Regis J Betsch
*Assistant Examiner* — Kaleria Knox
(74) *Attorney, Agent, or Firm* — Blank Rome, LLP

(57) ABSTRACT

Systems and methods for predicting an accurate in-situ stress field in a wellbore in a formation are disclosed. The in-situ stress field is calculated using an optimizing process that takes into account parameters relating to induced tensile fracture that are derived from wellbore image logs and other input data relating to the wellbore. Once values for the in-situ stress field are predicted, those values can be used to generate synthetic image logs and fracturing data which can then be compared to the original image logs and fracturing data to determine the accuracy of the results and if needed repeat the operation to obtain more accurate results.

53 Claims, 11 Drawing Sheets

(56) References Cited

U.S. PATENT DOCUMENTS

| | | | | |
|---|---|---|---|---|
| 2012/0173216 | A1* | 7/2012 | Koepsell | E21B 49/00 703/6 |
| 2014/0078288 | A1 | 3/2014 | Wu | |
| 2014/0372094 | A1* | 12/2014 | Holland | G01V 11/00 703/10 |
| 2015/0134255 | A1* | 5/2015 | Zhang | G01V 1/40 702/7 |
| 2017/0023691 | A1* | 1/2017 | Donald | G01V 1/50 |

FOREIGN PATENT DOCUMENTS

| | | | |
|---|---|---|---|
| WO | 2013172813 | A1 | 11/2013 |
| WO | 2015/149237 | A1 | 10/2015 |

OTHER PUBLICATIONS

Cheng "Boundary Element Analysis of the Stress Distribution around Multiple Fractures: Implications for the Spacing of Perforation Clusters of Hydraulically Fractured Horizontal Wells" (Year: 2009).*

Collins "Sensitivity of elastic wave velocities to reservoir stress path" (Year: 2005).*

Peska, Pavel, et al., "Compressive and tensile failure of inclined well bores and determination of in situ stress and rock strength", Journal of Geophysical Research, vol. 100, No. B7, pp. 12,791-12,811, Jul. 10, 1995.

First Office Action in counterpart CA Appl. 2929912, dated Jan. 30, 2018, 4-pgs.

Combined Search and Examination Report in counterpart UK Appl. GB1608757.9, dated Nov. 7, 2016, 10-pgs.

Second Office Action in counterpart CA Appl. 2929912, dated Dec. 13, 2018, 4-pgs.

Examination Report in counterpart UK Appl. GB1608757.9, dated Mar. 1, 2019, 4-pgs.

Intention to Grant in counterpart UK Appl. GB1608757.9, dated Jul. 16, 2019, 2-pgs.

* cited by examiner

SYSTEM AND METHOD FOR STRESS INVERSION VIA IMAGE LOGS AND FRACTURING DATA

TECHNICAL FIELD

This disclosure relates generally to the field of subsurface formation stress evaluation and in particular to methods and systems for stress inversion by using subsurface image logs and fracturing data.

BACKGROUND

When a wellbore is drilled, in-situ stress field creates a stress concentration or perturbation around the wellbore. When this stress concentration exceeds the strength of the rock, failure can occur in either compression or tension. Stress-induced wellbore failures are commonly referred to as induced tensile fractures and breakouts. Induced tensile fractures are small-scale fractures that generally occur only in the wall of the borehole and follow the stress concentration around the wellbore. Due to their small size, these fractures are sometimes only detected through detailed wellbore imaging. Because these fractures generally result from the stress concentration existing around the wellbore, their location around the wellbore (referred to in this document as induced tensile fracture orientation) and their angle with respect to the borehole axis (referred to in this document as induced tensile fracture trace angle) may be directly related to the magnitude and orientation of the stress concentration around the wellbore as well as the in-situ (far-field) stress.

Knowledge of formation parameters such as in-situ stress field can be helpful in wellbore stability design, fracture modeling, and production optimization among others. Taking into account the in-situ stress field and the resulting near-wellbore stress concentration may be particularly important in the design of a wellbore, as the amount of stress may be directly related to wellbore wall failures. As a result, accurately and efficiently estimating the in-situ stress field is an important part of increasing overall efficiency of the operation. The following disclosure addresses these and other issues.

SUMMARY

In one embodiment a non-transitory program storage device, readable by a processor is provided. The non-transitory program storage device includes instructions stored thereon to cause one or more processors to receive at least one image log for a wellbore in a formation, to receive one or more input parameters relating to the wellbore, to determine based on the image log, one or more parameters relating to one or more induced tensile fractures in the wellbore, and to calculate values for parameters relating to an in-situ stress field, wherein the calculation is done by utilizing an optimization process used to select in-situ stress field parameters least likely to be erroneous.

In another embodiment, a method for determining in-situ stress field values for a wellbore in a formation is provided. The method includes receiving at least one image log for the wellbore, receiving one or more input parameters relating to the wellbore, determining based on the image log, one or more parameters relating to one or more induced tensile fractures in the wellbore, and calculating values for parameters relating to an in-situ stress field, wherein the calculation is done by utilizing an optimization process used to select in-situ stress field parameters least likely to be erroneous.

In yet another embodiment, a system is provided. The system includes, in one embodiment, a memory, a display device, and a processor operatively coupled to the memory and the display device and adapted to execute program code stored in the memory. The program code is executed to receive at least one image log for a wellbore in a formation, to receive one or more input parameters relating to the wellbore, to determine based on the image log, one or more parameters relating to one or more induced tensile fractures in the wellbore, and to calculate values for parameters relating to an in-situ stress field, wherein the calculation is done by utilizing an optimization process used to select in-situ stress field parameters least likely to be erroneous.

In one embodiment a non-transitory program storage device, readable by a processor is provided. The non-transitory program storage device includes instructions stored thereon to cause one or more processors to receive one or more parameters relating to an in-situ stress field in a formation, receive one or more input parameters relating to the wellbore, and generate one or more synthetic image logs for the wellbore, wherein the one or more synthetic image logs are generated based on the one or more parameters relating to the in-situ stress field and the one or more input parameters.

In another embodiment, a method for generating one or more synthetic image logs for a wellbore in a formation is provided. The method includes receiving one or more parameters relating to an in-situ stress field in a formation, receiving one or more input parameters relating to the wellbore, and generating one or more synthetic image logs for the wellbore, wherein the one or more synthetic image logs are generated based on the one or more parameters relating to the in-situ stress field and the one or more input parameters.

In yet another embodiment, a system is provided. The system includes, in one embodiment, a memory, a display device, and a processor operatively coupled to the memory and the display device and adapted to execute program code stored in the memory. The program code is executed to receive one or more parameters relating to an in-situ stress field in a formation, receive one or more input parameters relating to the wellbore, and generate one or more synthetic image logs for the wellbore, wherein the one or more synthetic image logs are generated based on the one or more parameters relating to the in-situ stress field and the one or more input parameters.

DESCRIPTION OF DISCLOSED EMBODIMENTS

Figure 1A:
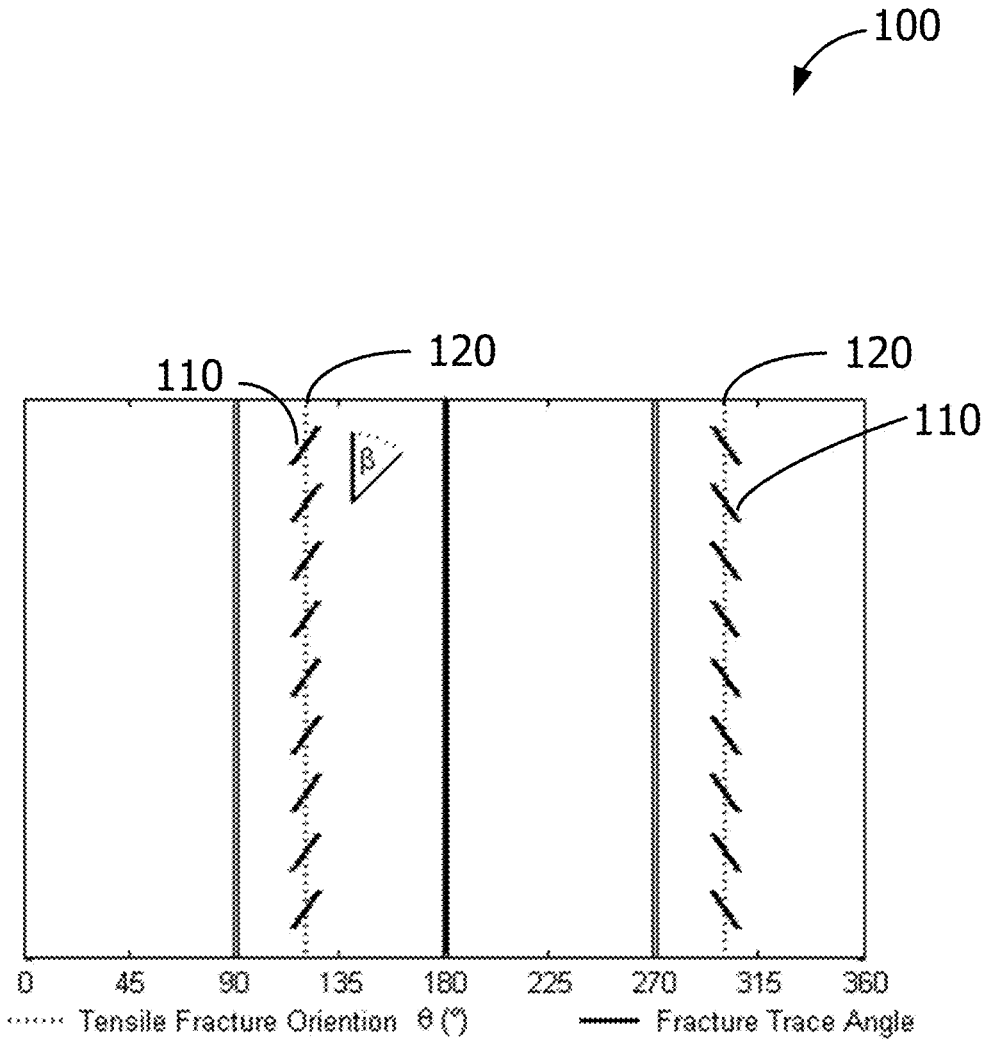
FIG. 1A shows an example of a wellbore image log showing various induced tensile fractures.

In the following description, for purposes of explanation, numerous specific details are set forth in order to provide a thorough understanding of the inventive concept. As part of this description, some of this disclosure's drawings represent structures and devices in block diagram form in order to avoid obscuring the invention. Reference in this disclosure to "one embodiment" or to "an embodiment" means that a particular feature, structure, or characteristic described in connection with the embodiment is included in at least one embodiment of the invention, and multiple references to "one embodiment" or "an embodiment" should not be understood as necessarily all referring to the same embodiment.

It will be appreciated that in the development of any actual implementation (as in any development project), numerous decisions must be made to achieve the developers' specific goals (e.g., compliance with system- and business-related constraints), and that these goals will vary from one implementation to another. It will also be appreciated that such development efforts might be complex and time-consuming, but would nevertheless be a routine undertaking for those of ordinary skill in the art of data processing having the benefit of this disclosure.

In drilling a wellbore, it is common to come across induced tensile fractures or breakouts on the wall of the wellbore being drilled. These induced tensile fractures or breakouts generally result from stress concentrations (compressive or tensile) produced around the wellbore. Near wellbore stress concentration is controlled by the in-situ stress field, wellbore trajectory, among other factors. As a result, these induced tensile fractures and breakout properties are directly related to the magnitude and orientation of the in-situ stress field and corresponding near-wellbore stress concentration. For example, induced tensile fracture orientation around the wellbore and trace angle is generally a function of the in-situ stress field and the resulting near-wellbore stress concentration. Thus, by studying the orientation of induced tensile fractures around the wellbore along with their induced tensile fracture trace angle and taking into account other formation properties such as, wellbore trajectory one may be able to estimate the magnitude and orientation of the in-situ stress field. Because induced tensile fractures can be detected in detailed wellbore image logs, studying such logs of a wellbore is the first step, in some embodiments, in determining the magnitude and orientation of the in-situ stress field. Once the in-situ stress field and the resulting near-wellbore stress concentration have been determined, the estimates can be used to create synthetic wellbore image logs. The results can then be compared to the actual image logs to verify the accuracy of the estimates. If the estimated numbers do not result in images that are within an acceptable range of accuracy with respect to the original images, the process of estimation may be repeated with a higher degree of accuracy until the verification results in acceptable estimates.

Figure 1B:
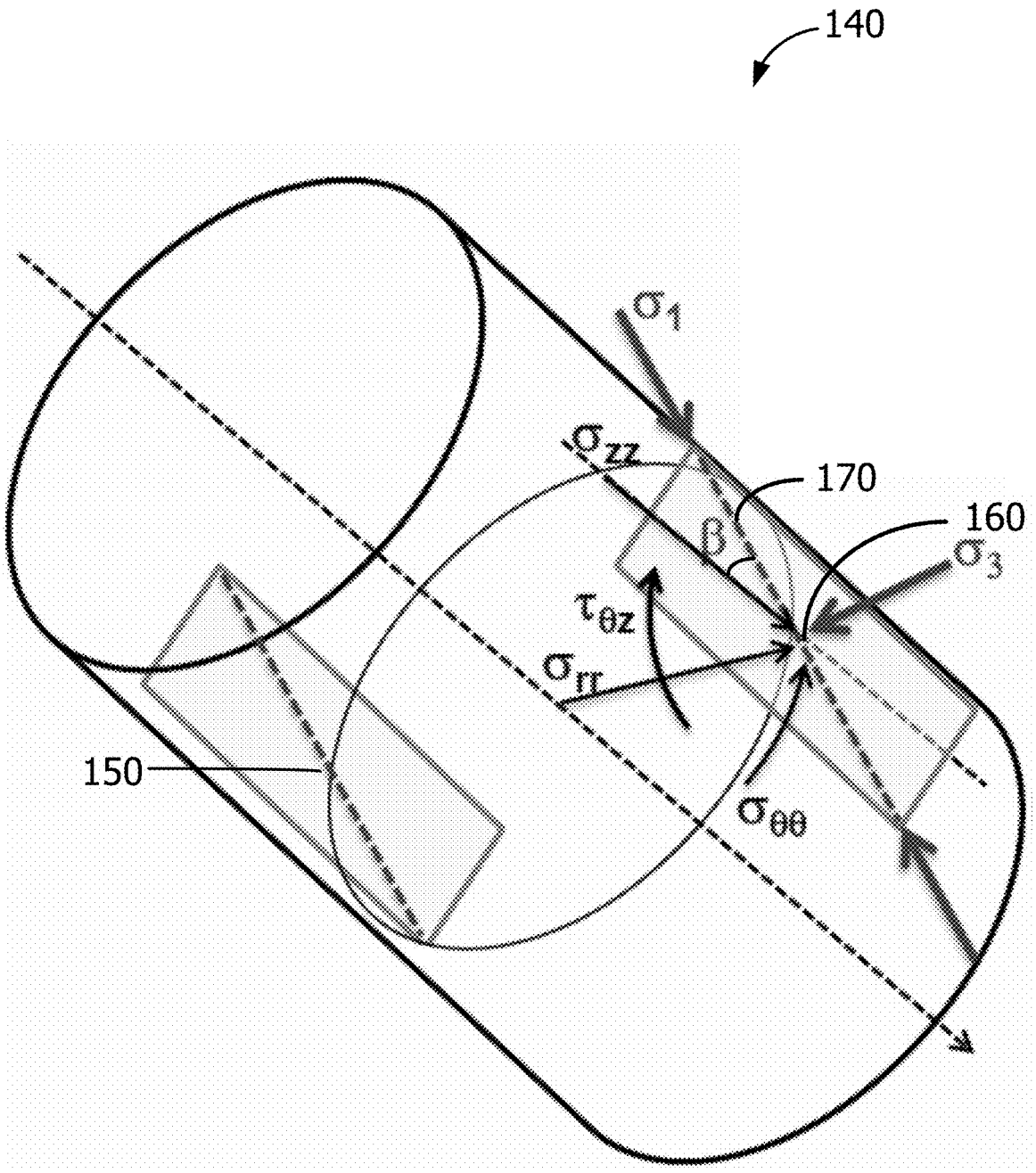
FIG. 1B shows an example of wellbore wall stress components, induced tensile fracture orientation and induced tensile fracture trace angle.

FIG. 1A illustrates an example wellbore image 100 showing induced tensile fractures. The same features can be observed on actual image logs from a wellbore. The vertical dashed lines 120 show the orientation of induced tensile fractures around the wellbore wall. The lines 110 propagating away from the vertical lines 120 illustrate the trace angle of induced tensile fractures created on the wall of the wellbore. As shown in FIG. 1A, such a wellbore image illustrates the orientation around the wellbore and trace angle of induced tensile fractures on the wellbore wall. FIG. 1B illustrates how these properties are related to the in-situ stress field.

Stress concentration around the wellbore is a function of in-situ stress field, wellbore trajectory and other factors. As such, depending on the amount of stress concentration on the wellbore wall, induced tensile fractures might occur during a drilling operation. For example, FIG. 1B shows stress concentration on the wellbore wall for a deviated wellbore 140. As shown, at a point 160 on the wellbore wall, the induced tensile fracture has a trace angle of $\beta$, 170 with respect to the wellbore axis. The location of this point around the wellbore and the trace angle are both a function of near-wellbore stress concentration resulting from the in-situ stress field. Due to an existing shear stress component on the wellbore wall, labeled as $\tau_{\theta Z}$, the maximum principle stress component, $\sigma_1$ has the trace angle $\beta$, 170 with respect to wellbore axis. Another principle stress component on the wellbore wall is shown as the stress component $\sigma_3$. A third principle stress component at this location, $\sigma_{rr}$ represents a radial stress which is perpendicular to the borehole wall. As shown in FIG. 1B, induced tensile fractures happen at two locations, 160 and 150 around the wellbore which are 180 degrees apart.

Figure 1C:
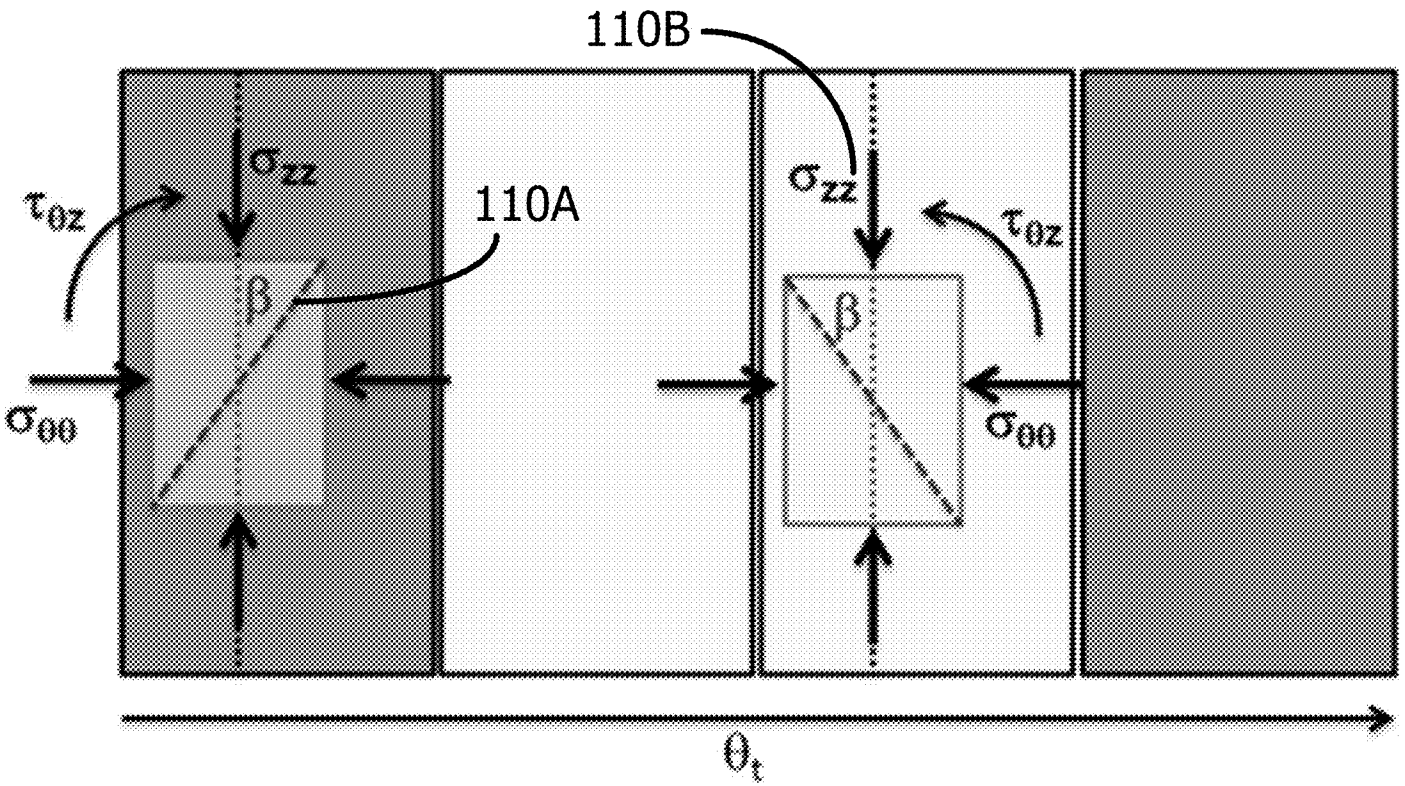
FIG. 1C shows another example of wellbore wall stress components, induced tensile fracture orientation and induced tensile fracture trace angle.

Induced tensile fracture information shown around the wellbore on FIG. 1B can be translated to an image log in rectangular coordinates as shown in FIG. 1C. As illustrated in FIG. 1C, induced tensile fracture 110A occurs at an orientation $\theta_t$ around the wellbore (measured clock-wise from the top of the wellbore) and has a trace angle $\beta$ measured from the borehole axis. At the point where induced tensile fracture 110A occurs, the three arrows $\sigma_{zz}$, $\tau_{\theta Z}$ and $\sigma_{\theta\theta}$ represent the wellbore wall stress components resulting from the in-situ stress field. An induced tensile fracture 110B which is similar to the induced tensile fracture 110A occurs at a location 180 degree apart from the induced tensile fracture 110A under similar stress concentration.

As illustrated in FIGS. 1A-1C, induced tensile fracture trace angle and orientation around the wellbore are related to the wellbore wall stress concentration. This stress concentration is a function of magnitude and direction of the in-situ stress field. Thus, by carefully examining the existence, trace angle and orientation of induced tensile fractures on wellbore images, the magnitude and direction of the in-situ stress field may be determined.

Figure 2A:
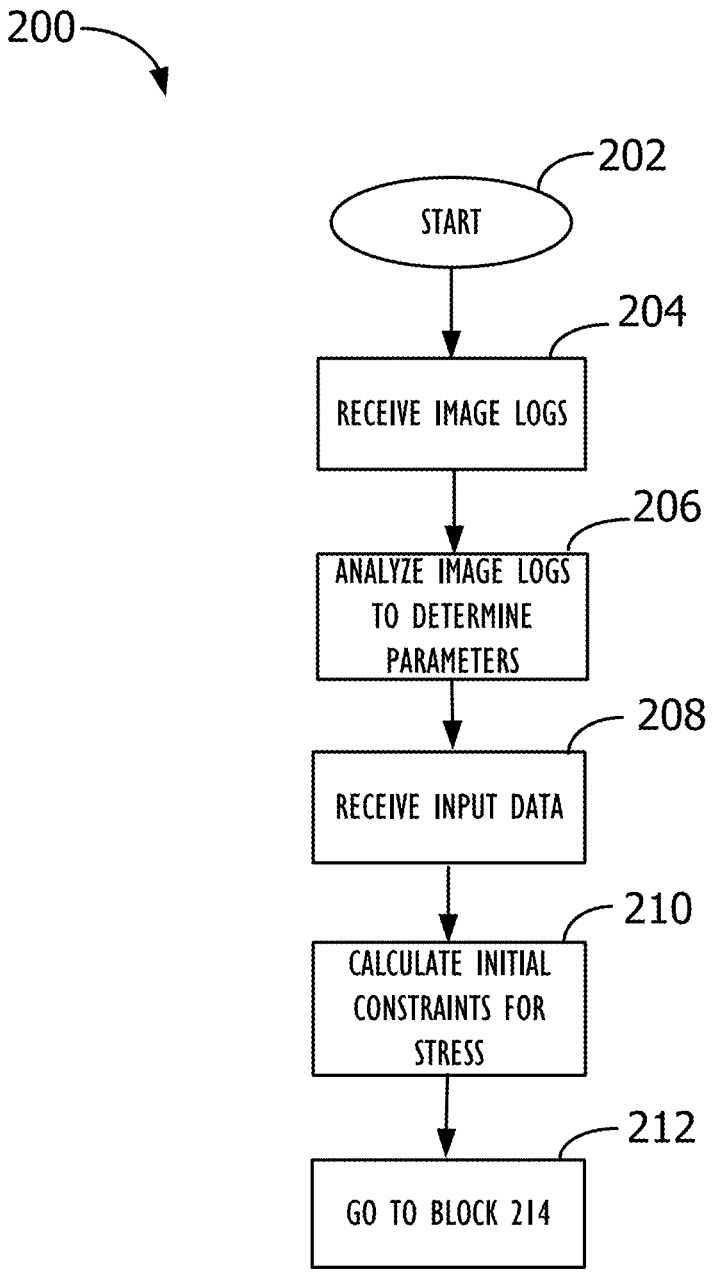
FIGS. 2A-2B show flowcharts for performing stress inversion and verification operations, according to one or more disclosed embodiments.
Figure 2B:
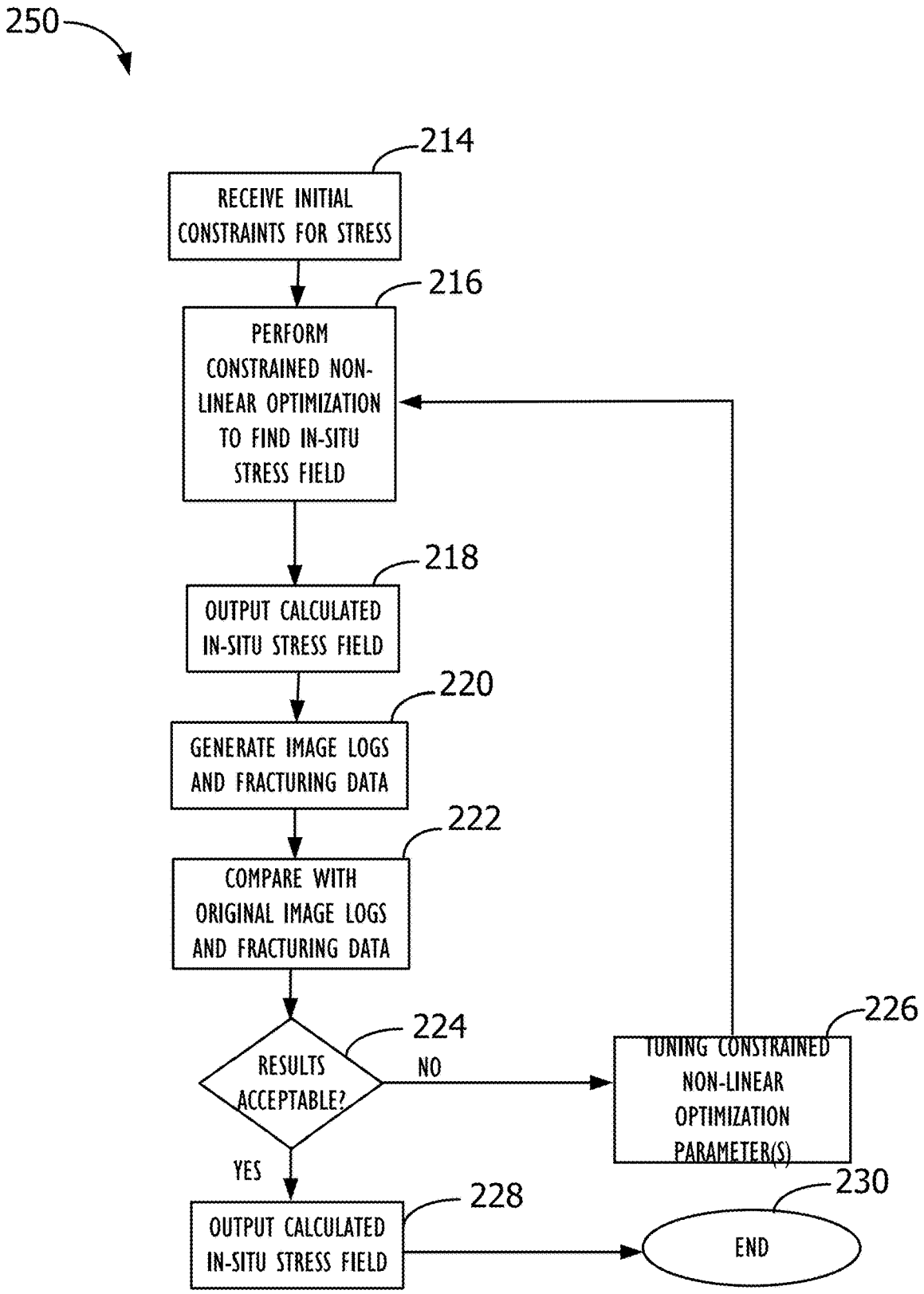

FIGS. 2A-2B provide a flow chart for an operation involving stress inversion via image log and fracturing data, according to one embodiment. Operation 200 starts (block 202) by receiving image logs (block 204) from one or more sources. In one embodiment, the image logs are generated using devices such as Compact Micro Imager (CMI), which provide detailed wellbore image logging. Other types of device which provides detailed wellbore imaging may also be used. Once the image logs are received, they are analyzed to determine parameters relating to induced tensile fractures (block 206). For example, the images may be analyzed to determine, induced tensile fracture trace angle and orientation around the wellbore.

In addition to specific parameters relating to induced tensile fractures, other geological or specific types of data relating to the wellbore may be needed to evaluate the in-situ stress field. Such input data is received either directly through user input or by accessing other wellbore logs and files. For example, the input data may include fracture initiation pressure which may be provided from leak-off tests. Input data may also include one or more of pore pressure, Poisson's ratio, inclination, azimuth, depth, friction, temperature, and mud cake properties. In one embodiment, input data may also include the type of faulting regime. For example, the location may be indicated as normal faulting (NF), strike-slip faulting (SS) or reverse faulting (RF). This information is generally known based on the geological area and may either be input by a user or may be provided to the operation by wellbore logs or files.

Figure 3:
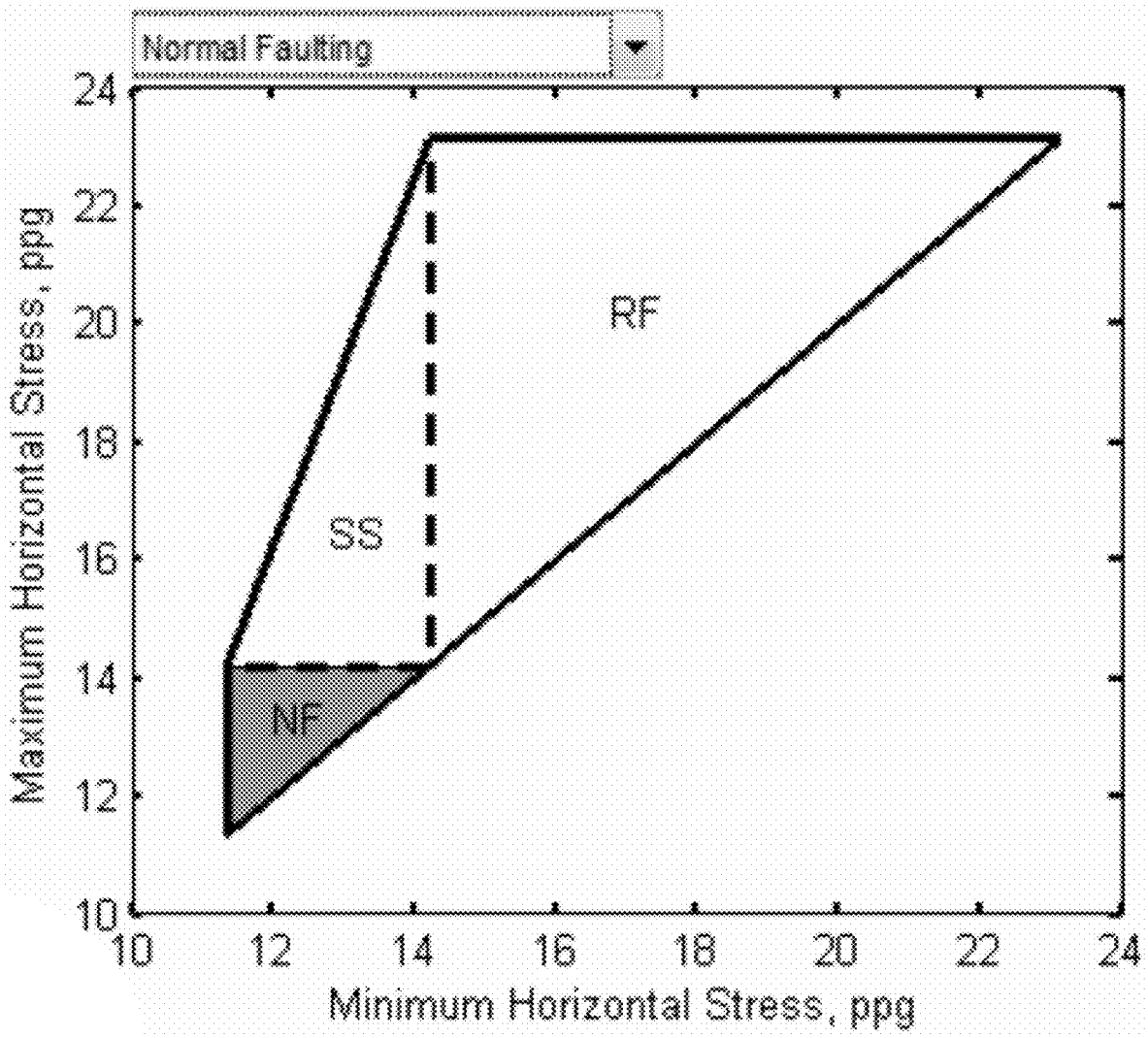
FIG. 3 shows a chart illustrating an example of ranges of stress values for different types of faulting regimes.

Information relating to the wellbore's faulting regime is used by the operation 200 to provide an initial constraint for the in-situ stress field based on a stress polygon. As shown in FIG. 3, a pre-determined range of possible horizontal stress magnitudes exists for each type of faulting regime. This information may be available empirically or may have been derived through other calculations. As an example, for each type of faulting regime, there may be a potential range of magnitudes for minimum and maximum horizontal stresses. This information can be used to estimate the in-situ stress field utilizing a constrained non-linear optimization technique.

Referring back to FIG. 2A, once all input data has been received, the operation 200 performs some calculations to determine initial constraint values for the in-situ stress field (block 210). In one embodiment, these calculations are based on a stress polygon. Once the initial constraints have been determined, the operation 200 proceeds to block 214 of operation 250 shown in FIG. 2B.

In one embodiment, operation 250 starts by receiving the calculated initial constraint values (block 214). Once the constraint values are received, in one embodiment, the next step is to determine the in-situ stress values based on the received input data. To do so, in one embodiment, three non-linear equations are developed which can relate the induced tensile fracture orientation around the wellbore, $\theta_t$, induced tensile fracture trace angle, $\beta$, and fracture initiation pressure, FIP, to the minimum horizontal stress, maximum horizontal stress, vertical stress, maximum horizontal direction, wellbore inclination, wellbore azimuth, and a number of other properties that can be received as input data. These three equation can be formulated as follows:

$$\theta_t = f_1(\sigma_h, \sigma_H, \sigma_v, \sigma_{HDir}, \gamma, \varphi, P_0, v, \text{Temp}, \text{Mud Cake}) \quad (1)$$

$$\beta = f_2(\sigma_h, \sigma_H, \sigma_v, \sigma_{HDir}, \gamma, \varphi, P_0, v, \text{Temp}, \text{Mud Cake}) \quad (2)$$

$$\text{FIP} = f_3(\sigma_h, \sigma_H, \sigma_v, \sigma_{HDir}, \gamma, \varphi, P_0, v, \text{Temp}, \text{Mud Cake}) \quad (3)$$

Where $\theta_t$ in equation (1) represents induced tensile fracture orientation around the wellbore, $\beta$ represents induced tensile fracture trace angle and FIP represents fracture initiation pressure. Moreover, $\sigma_h$ is the minimum horizontal stress, $\sigma_H$ is the maximum horizontal stress, $\sigma_v$ is the vertical stress, $\sigma_{HDir}$ is the maximum horizontal stress direction, $\gamma$ is wellbore inclination, $\varphi$ is wellbore azimuth, $P_0$ is pore pressure, and v is Poisson's ratio. Additionally, Temp can include temperature related parameters, and Mud Cake may represent mud cake related parameters affecting near-wellbore pore pressure. Thus, knowing all of the above parameters except for minimum horizontal stress, maximum horizontal stress, and maximum horizontal stress direction, results in having three non-linear equations with three unknown parameters which can be easily calculated.

In order to find the most accurate results, operation 250 performs constrained non-linear optimization (block 216) to solve the above-mentioned three equations and find values for the minimum horizontal stress, the maximum horizontal stress, and the maximum horizontal stress direction. In one embodiment, this is done by assuming that we are given a 3-tuple of interpreted data based on direct measurements i.e., ($\theta_t$,$\beta$,FIP). It is further presumed that each recorded data value in the 3-tuple can be modeled using a known analytical model. Assuming that $f_{1,m}(.)$, $f_{2,m}(.)$, and $f_{3,m}(.)$ stand for the analytical models of $\theta_t$, $\beta$, and FIP, respectively and m is a known parameter vector, m can be written as:

$$m = (\sigma_v, \gamma, \varphi, P_0, v, \text{Temp}, \text{Mud Cake}) \quad (4)$$

The analytical models are each a function of $\sigma_h$, $\sigma_H$, and $\sigma_{HDir}$. The lower and upper bounds of these parameters are generally known based on faulting regime data. That is:

$$\begin{cases} \sigma_{h_1} \le \sigma_h \le \sigma_{h_2} \\ \sigma_{H_1} \le \sigma_H \le \sigma_{H_2} \\ 0 \le \sigma_{HDir} \le 180 \end{cases}$$

The problem to solve is to uncover the unknown 3-tuple of ($\sigma_h$,$\sigma_H$,$\sigma_{HDir}$) given the observed (i.e., interpreted) data ($\theta_t$,$\beta$,FIP). Because observed data is generally inherently noisy the problem is naturally amenable to an optimization problem where the objective becomes to find the sequence for ($\sigma_h$,$\sigma_H$,$\sigma_{HDir}$) minimizing the difference between the modeled values and the observations. As the input variables are constrained and the model functions are nonlinear, the problem becomes that of a constrained nonlinear optimization which can be written as:

$$\underset{(\sigma_h, \sigma_H, \sigma_{HDir})}{\text{argmin}} \; \|(\theta_t, \beta, FIP) - (f_{1,m}(\sigma_h, \sigma_H, \sigma_{HDir.}), f_{2,m}(\sigma_h, \sigma_H, \sigma_{HDir.}), f_{3,m}(\sigma_h, \sigma_H, \sigma_{HDir.}))\| \quad (5)$$

$$\text{subject to} \begin{cases} \sigma_{h_1} \le \sigma_h \le \sigma_{h_2} \\ \sigma_{H_1} \le \sigma_H \le \sigma_{H_2} \\ 0 \le \sigma_{HDir} \le 180 \end{cases}$$

Where ||.|| is any norm function used to assess the difference between the model values and the observations. One such norm function is the Euclidean norm. It should be noted that this norm function may include a non-uniform weighting scheme to account for the relative importance of each observation. Once we arrive at equation (5), the equation can be solved using any constrained nonlinear optimization method known in the art.

Referring back to FIG. 2B, after the equation is solved, the resulting values can then be provided as an output of the operation 250 (block 218). The output may be provided to a user on a screen, may be stored on a storage medium, or may be sent via electronic means to other devices and/or users. In an alternative embodiment, the optimized values may not be provided as an output at this stage of the operation. Instead, a verification operation may be performed to verify the results before they are provided as an output. In another embodiment, after the results have been outputted, the user or a program running the operation may decide to verify the results. This is made possible because by knowing the values for the in-situ stress field and the input values received by the program, parameters for the induced tensile fracture such as the induced tensile fracture orientation around the wellbore, the tensile fracture trace angle and fracture initiation pressure can be calculated. These parameters can then be used to generate synthetic image logs and fracturing data which can then be compared against the original image logs and fracturing data to verify the accuracy of the calculations. This is done by the remaining steps outlined in operation 250 of FIG. 2B.

In one embodiment, when a decision is made as to whether or not the results should be verified, it may be done by presenting the user with a choice to decide whether or not to proceed with verification. Alternatively, the decision may be made internally by the operation through evaluating some pre-determined parameters.

After the calculated in-situ stress field values have been outputted or it is determined that the results should be verified, the operation proceeds to generate synthetic image logs and fracturing data (block 220) based on the optimized stress field parameters calculated. This is done, in one embodiment, by using equations (1)-(3) above to calculate values for the induced tensile fracture orientation and the trace angle and fracture initiation pressure based on the calculated stress values. The induced tensile fracture orientation and trace angle can then be used to generate synthetic image logs. The process of generating synthetic image logs may be referred to as forward modeling, and has multiple applications.

Once the synthetic image logs are created, they are compared to the original image logs (block 222) to determine if there are any differences between them. In one embodiment, the calculated fracture initiation pressure is also compared against the received fracture initiation pressure value. Since most of the other parameters used for calculating the stress field, synthetic image logs and fracturing data have known values, any difference between the synthetic image logs and fracturing data, and the original ones is an indication of the accuracy of the stress field values calculated. If the stress field values are accurate, the synthetic image logs and fracturing data generated should be closely similar to the original data. When they are not, the degree to which the two sets of data are different is an indication of the accuracy of the results.

In one embodiment, to determine the accuracy, the induced tensile fracture orientation, trace angle of the synthetic image logs and calculated fracture initiation pressure are compared against those same parameters for the original image logs and fracturing data. In one embodiment, the comparison is done by a user manually comparing the two sets of numbers. In an alternative embodiment, the comparison is done by operation 250 and a percentage of variation between the two sets of numbers is calculated. This percentage of variation is then evaluated to determine if the results are within an acceptable range (block 224). In one embodiment, the acceptable range is a pre-determined range. In the embodiment where the user manually compares the results, the determination of whether or not the results are acceptable may be made by the user. If the results are determined to be acceptable, operation 250 outputs the calculated stress values (block 230) and then proceeds to block 232 to end the operation. When the results are not deemed acceptable, the constrained non-linear optimization process can be tuned (block 226). In one embodiment, this is done by allocating more computational time which results in increased accuracy. In one embodiment, the tuning process is done automatically by the operation. For example, the operation 250 may tune constrained non-linear optimization parameters depending on the percentage of variation between the synthetic and original image logs and fracturing data. Alternatively, a user may decide on the tuning needed for the increased accuracy and may provide these values to the operation 250.

Once the values for tuning the constrained non-linear optimization problem have been received and/or determined, operation 250 once more performs a constrained non-linear optimization process (block 228) to optimize the values found for the minimum horizontal stress, the maximum horizontal stress, and the maximum horizontal stress direction. In one embodiment, these values are then provided as an output of the operation (block 228). The output may be provided to a user on a screen, may be stored on a storage medium, or may sent via electronic means to other devices and/or users. In one embodiment, the process of verifying the results and recalculating them (blocks 216-224) may be repeated until acceptable results are found (block 224) at which point the acceptable results may be provided as an output (block 228) and the operation may end (block 230).

Thus, operations 200 and 250 provide efficient and highly optimized procedures to calculate and verify optimized values for the in-situ stress field by evaluating wellbore image logs and fracturing data. As discussed above, the procedures may be automated such that minimal user input and interaction is required, thus saving time and user resources. Alternatively, the process may involve direct interaction with users. For example, user interface screens such as the ones shown in FIGS. 4A-4E may be used to receive input from a user and provide the user with information and outputs about the procedures.

Figure 4A:
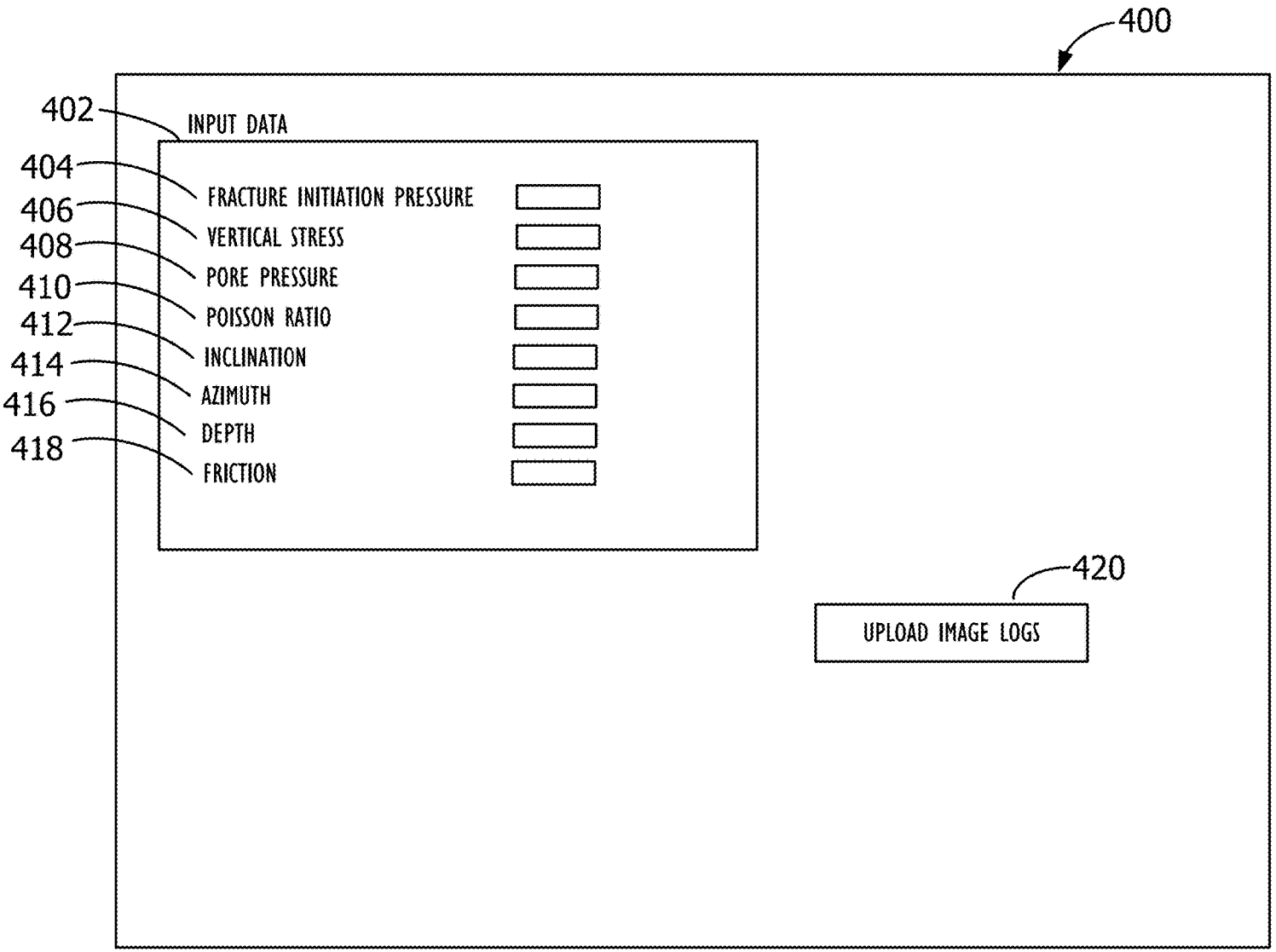
FIGS. 4A-4E show user interface screens for performing stress inversion and verification operations, according to one or more disclosed embodiments.
Figure 4B:
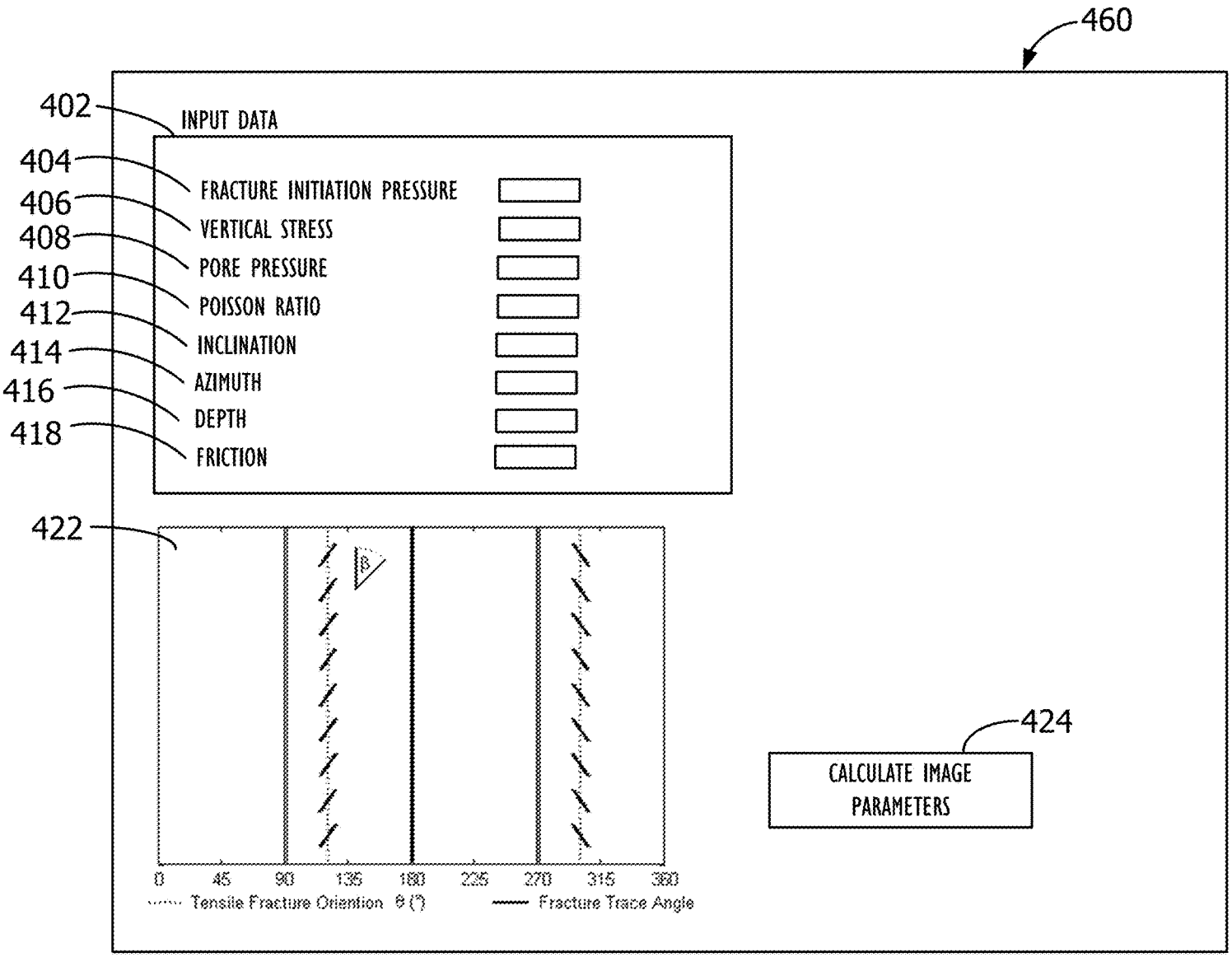

FIG. 4A illustrates an example screen 400 which may be provided to a user to input various parameters relating to the wellbore being analyzed. In one embodiment, screen 400 includes an input data section 402 for inputting the various parameters. These parameters include, in one embodiment, fracture initiation pressure 404, vertical stress 406, pore pressure 408, Poisson's ratio 410, inclination 412, azimuth 414, depth 416, and friction 418. It should be noted that these parameters are merely shown as examples. Other parameters may be added to this list in alternative embodiments. For example, in one embodiment, parameters relating to temperature and pore pressure (Mud-cake) effects on near-wellbore stress concentration can also be included. Furthermore, some of the parameters shown may be removed in other embodiments. In yet other embodiments, the user may have the option of providing input values for only a subset of the parameters listed in the input data section 402. Once all the required input data has been entered, the user may select the upload image logs button 420 to retrieve image logs for the wellbore. The image logs may be have been stored locally or a on a network or cloud and are retrieved so that they can be analyzed.

Once retrieved, one or more wellbore image logs may be presented to the user on a user screen. In one embodiment, the image logs are used to generate charts illustrating induced tensile fracture parameters for the wellbore and such charts are presented to the user. An example of such a chart is shown in screen 460 of FIG. 4B. As shown, chart 422 illustrates induced fracture trace angles at different induced tensile fracture orientations around the wellbore. In this manner, the user is able to get an overview of the induced tensile fracture parameters for the wellbore. Alternatively, the screen 460 may present an actual image log to the user. After reviewing the image log and/or chart, the user is able to select calculate image parameters 440 to obtain the specific induced tensile fracture parameters for the wellbore.

Figure 4C:
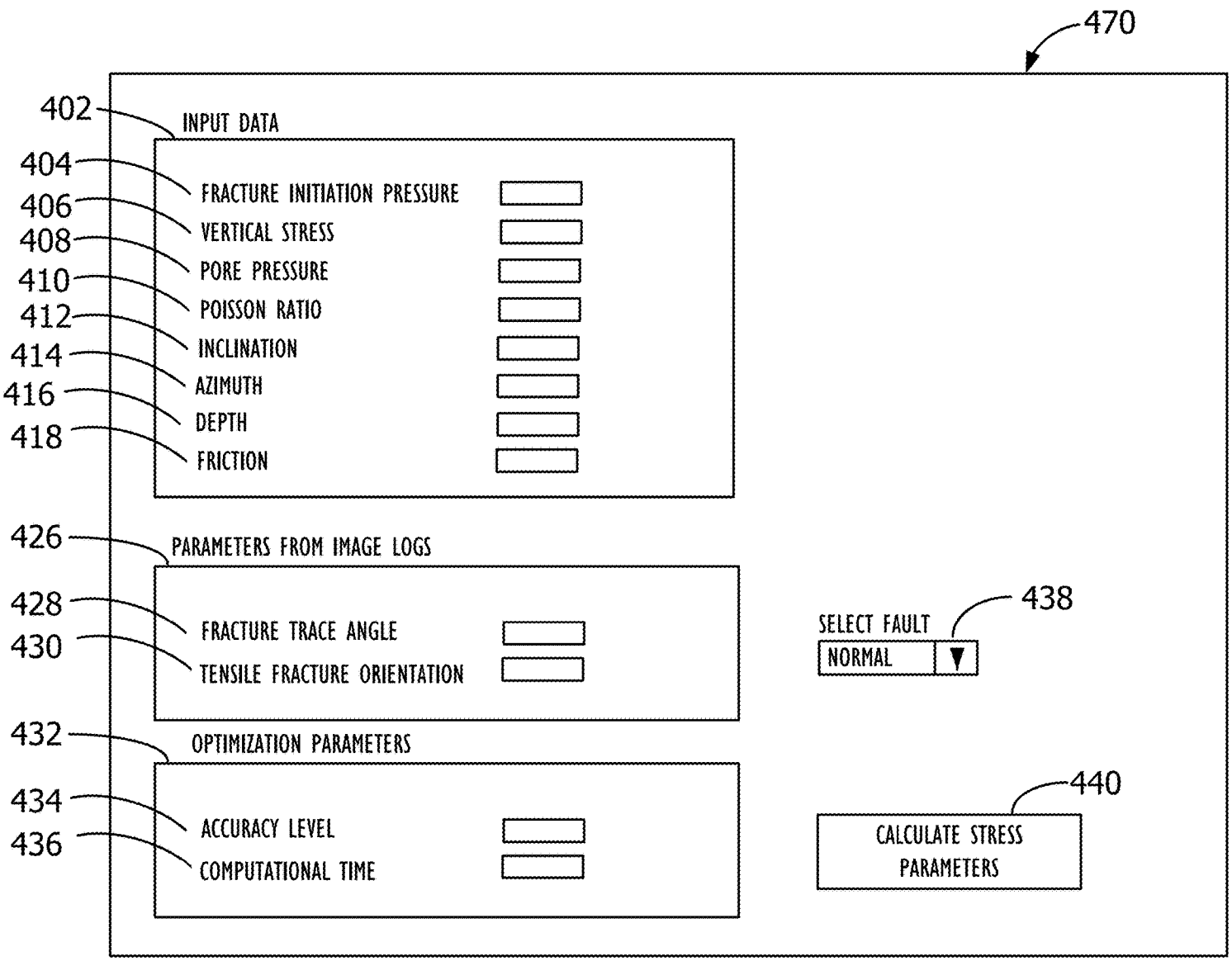
Figure 4D:
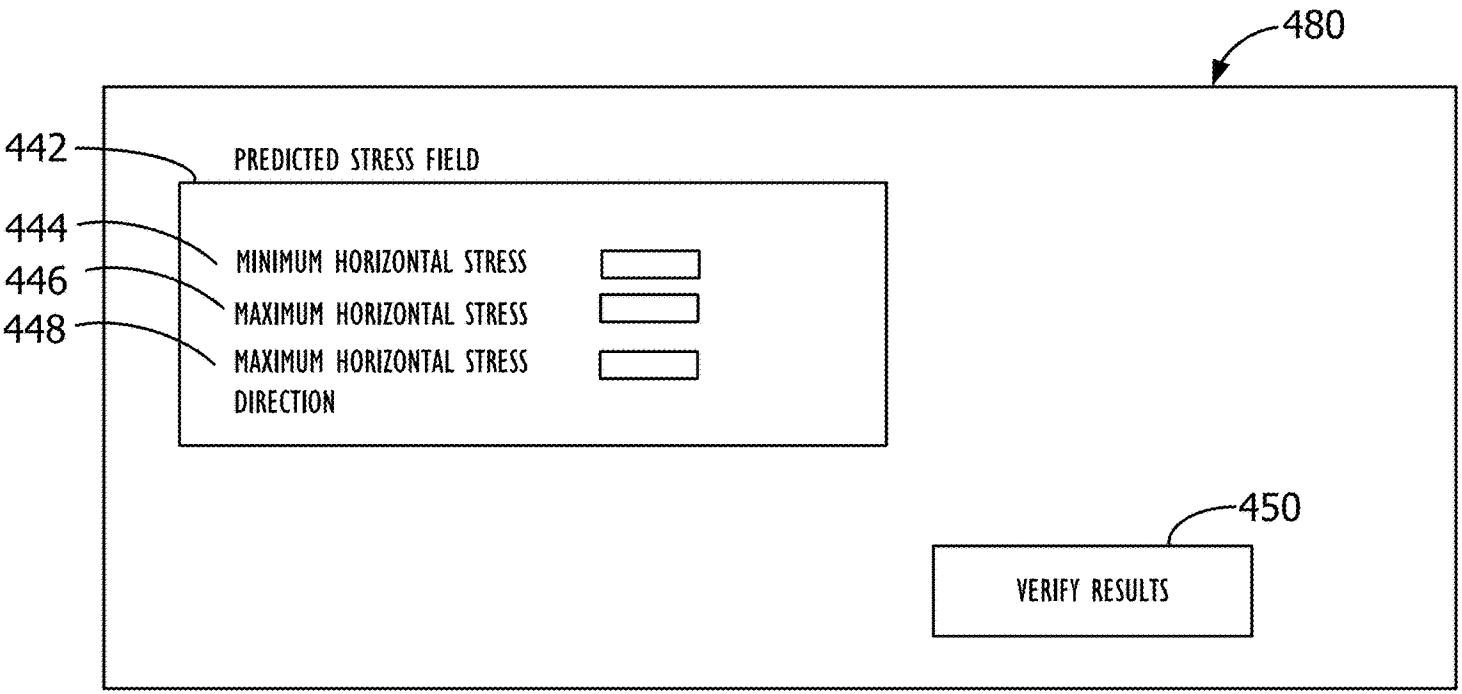
Figure 4E:
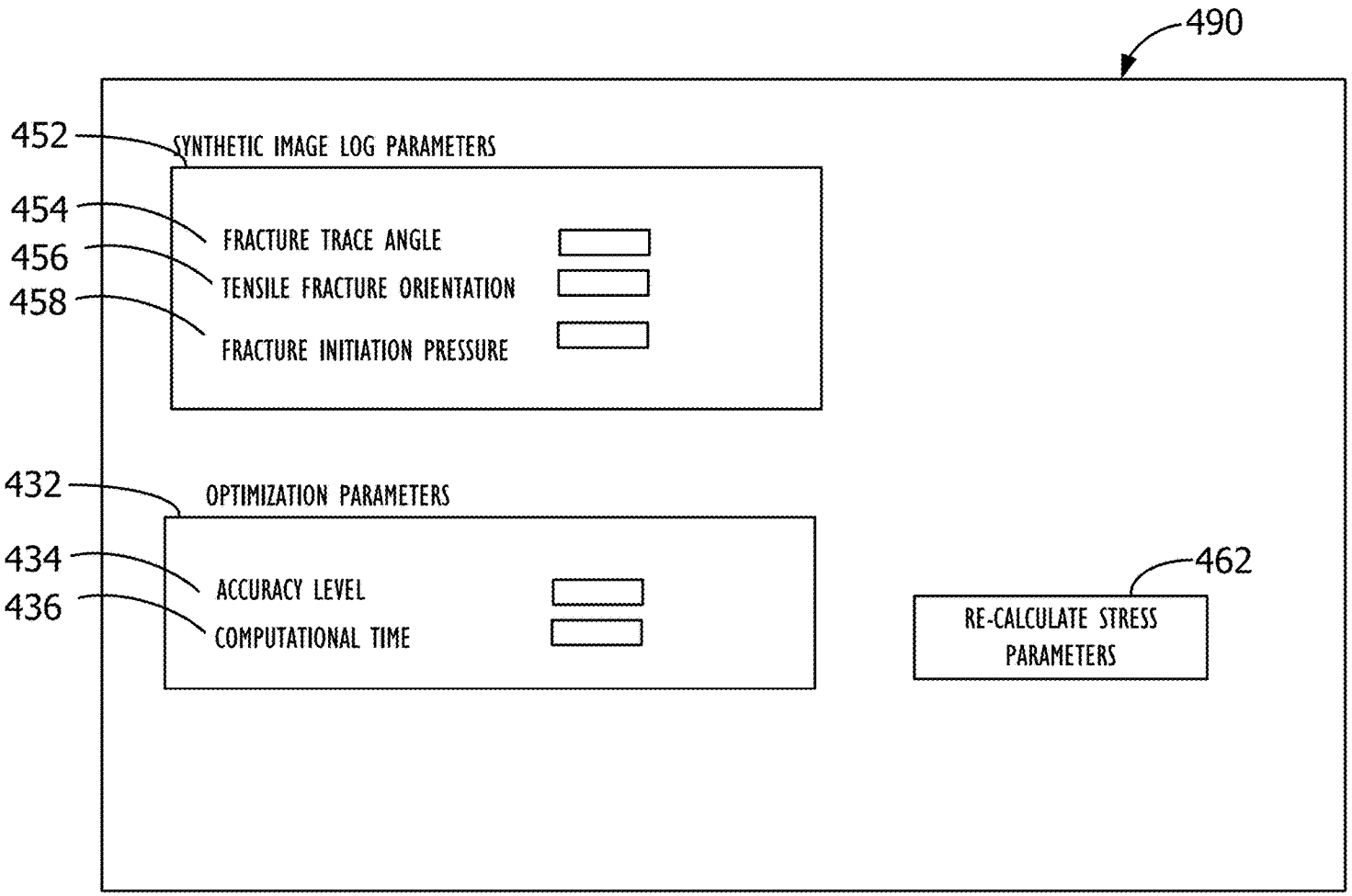

In one embodiment, after selecting calculate image parameters 440, the user is presented with a screen such as the screen 470 illustrated in FIG. 4C, which shows a section 426 for parameters from image logs. These parameters include induced tensile fracture trace angle 428 and induced tensile fracture orientation 430. Although, shown as blank in screen 470, the text boxes for fracture trace angle 428 and tensile fracture orientation 430 will be prefilled with the determined values for each parameter. Alternatively, instead of presenting the values in a screen such as screen 470, the parameters from image log 426 box may be in a pop-up box presented to the user. Other embodiments are also contemplated.

Screen 470 also enables the user to select from the dropdown menu 438 the type of faulting regime. In one embodiment, the types of faulting regime available in the drop-down menu 438 include normal faulting (NF), strike-slip faulting (SS) or reverse faulting (RF). This could include an unknown faulting regime as well. In one embodiment, selecting the available option for faulting regime specifies the initial constraint on the in-situ stress field. In addition, the parameters related to the constrained non-linear optimization technique can be specified in box 432. These values may be chosen by the user depending on the needs of the project and the application for which it is being used.

Once all desired parameters have been input and/or selected, the user may select calculate stress parameters 440 to initiate the optimization process for calculating the stress field parameters. Once the optimization process has finished running and results have been calculated, the user may be presented with a screen, such as screen 480 of FIG. 4D to view the results. Screen 480 includes a section 442 for presenting values for the predicted stress field. These values include the minimum horizontal stress 444, maximum horizontal stress 446, and maximum horizontal stress direction 448. Although, shown as blank in screen 470, the boxes for minimum horizontal stress 444, maximum horizontal stress 446, and maximum horizontal stress direction 448 will be prefilled with the calculated values for each parameter. At this point, the user can decide if the results need to be verified. When verification is needed, the user may select the verify results button 450 to start the verification process.

As discussed above, in order to verify the results, the predicted stress field values may be used to generate synthetic image logs and fracturing data which can then be compared to the original image logs retrieved for the wellbore being evaluated and imported fracture initiation pressure. In one embodiment, the comparison is done by the user. In such an embodiment, the user may be presented with a user interface screen such as screen 490 of FIG. 4E.

As shown, screen 490 includes a section 452 for displaying values for the calculated synthetic image log and fracturing data parameters. These parameters include, in one embodiment, induced tensile fracture trace angle 454, induced tensile fracture orientation 456, and fracture initiation pressure 458. The user can then compare these values with the induced tensile fracture values from the original image shown in section 426 of screen 470 and imported fracture initiation pressure to determine the difference between them. In one embodiment, screen 490 includes section 426 such that the user can view the two sets of values on one page. Alternatively, the user may be able to select a button that results in popping up those values.

Once the user has had an opportunity to review and compare the synthetic image log and fracturing data parameters with the original ones, a decision can be made as to whether or not the results need to be recalculated. When the user decides to recalculate the results, constrained non-linear optimization parameters can further be tuned to achieve increased accuracy. Once new optimization parameters have been input, the user may select the re-calculate stress parameters button 462 to redo the calculations. The process of verification and recalculation may be repeated until the user decides that the results are efficiently accurate.

The calculated stress field values may be used in analyzing and/or improving wellbore stability design, fracture modeling, fracture optimization and others. For example, the values can be used in borehole stress, stability and strengthening analyses, in identifying critically stressed fractures, and in stressed induced anisotropy modeling operations, or in calculating stress variations between fracture stages along horizontal or vertical wellbores. In addition, the calculated stress field may be used to generate a continuous log of synthetic image logs which in turn can guide image log interpretation when the data quality is low. Thus, the stress inversion operation predicts an accurate stress field along the length of the wellbore based on known parameters and parameters extracted from wellbore image logs and fracturing data. In the past this was done through a non-integrated and non-optimized analysis which generated a local minimum solution that could be highly inaccurate. One embodiment of the present invention provides an integrated and automated procedure for determining and verifying stress field parameters that is quick, efficient, highly accurate, and repeatable. The automated procedure employs a constrained non-linear optimization approach, which generates predicted results with the least possible margins of error.

Thus, the forgoing solutions provide embodiments for performing stress inversion for a wellbore automatically, accurately, and efficiently while providing the ability to verify the results.

In the foregoing description, for purposes of explanation, specific details are set forth in order to provide a thorough understanding of the disclosed embodiments. It will be apparent, however, to one skilled in the art that the disclosed embodiments may be practiced without these specific details. In other instances, structure and devices are shown in block diagram form in order to avoid obscuring the disclosed embodiments. References to numbers without subscripts or suffixes are understood to reference all instance of subscripts and suffixes corresponding to the referenced number. Moreover, the language used in this disclosure has been principally selected for readability and instructional purposes, and may not have been selected to delineate or circumscribe the inventive subject matter, resort to the claims being necessary to determine such inventive subject matter. Reference in the specification to "one embodiment" or to "an embodiment" means that a particular feature, structure, or characteristic described in connection with the embodiments is included in at least one disclosed embodiment, and multiple references to "one embodiment" or "an embodiment" should not be understood as necessarily all referring to the same embodiment.

It is also to be understood that the above description is intended to be illustrative, and not restrictive. For example, above-described embodiments may be used in combination with each other and illustrative process acts may be performed in an order different than discussed. Many other embodiments will be apparent to those of skill in the art upon reviewing the above description. The scope of the invention therefore should be determined with reference to the appended claims, along with the full scope of equivalents to which such claims are entitled. In the appended claims, terms "including" and "in which" are used as plain-English equivalents of the respective terms "comprising" and "wherein."

What is claimed is:

1. A non-transitory program storage device, readable by one or more processors and comprising instructions stored thereon to cause the one or more processors to:

receive at least one first image log for a wellbore in a formation generated by an image logging device imaging the wellbore in the formation;

receive one or more input parameters relating to the wellbore;

determine, based on the at least one first image log, observed values for in-situ stress field parameters relating to a minimum horizontal stress, a maximum horizontal stress, and a maximum horizontal stress direction of an in-situ stress field in the formation having one or more induced tensile fractures in the wellbore;

calculate, with the one or more input parameters, calculated values for the in-situ stress field parameters relating to the minimum horizontal stress, the maximum horizontal stress, and the maximum horizontal stress direction of the in-situ stress field in the formation, wherein the calculation is done by utilizing an optimization process minimizing a difference between the calculated values and the observed values for the in-situ stress field parameters;

verify the calculated values for the in-situ stress field parameters by generating at least one second image log based on the calculated values and comparing the at one received first image log to the at least one generated second image log; and indicate, based on the verified values for the in-situ stress field parameters, a step of stabilizing the wellbore, fracturing the wellbore, and/or producing from the wellbore.

2. The non-transitory program storage device of claim 1, wherein the in-situ stress field parameters relating to the one or more induced tensile fractures comprise an induced tensile fracture trace angle equation, a fracture initiation pressure equation, and an induced tensile fracture orientation equation, each of the equations being a non-linear function of the minimum horizontal stress, the maximum horizontal stress, and the maximum horizontal stress direction.

3. The non-transitory program storage device of claim 1, wherein the one or more input parameters relating to the wellbore comprise a type of faulting regime.

4. The non-transitory program storage device of claim 3, wherein the type of faulting regime comprises one of normal faulting, strike-slip faulting, and reverse faulting.

5. The non-transitory program storage device of claim 3, wherein the type of faulting regime selected provides an initial constraint range for the calculated values of the in-situ stress field parameters relating to the in-situ stress field.

6. The non-transitory program storage device of claim 1, wherein the one or more input parameters relating to the wellbore comprise a fracture initiation pressure.

7. The non-transitory program storage device of claim 1, wherein the one or more input parameters relating to the wellbore comprise parameters affecting near wellbore stress concentration.

8. The non-transitory program storage device of claim 1, wherein the optimization process comprises of a constrained non-linear optimization problem.

9. The non-transitory program storage device of claim 1, wherein to verify the calculated values for the in-situ stress field parameters relating to the in-situ stress field by comparing the at one received first image log to the at least one generated second image log, the instructions stored thereon further cause the one or more processors to:

calculate at least one fracture initiation pressure value based on the calculated values for the in-situ stress field parameters relating to the in-situ stress field;

calculate a value for an amount of variation between the generated second image log and the at least one calculated fracture initiation pressure value to the at least one received first image log and a received fracture initiation pressure value; and determine that the calculated values for the in-situ stress field parameters relating to the in-situ stress field are accurate based on the amount of variation.

10. The non-transitory program storage device of claim 9, wherein the instructions stored thereon further cause the one or more processors to recalculate values for the in-situ stress field parameters relating to the in-situ stress field in response to a determination that the calculated values for the in-situ stress field parameters relating to the in-situ stress field are outside an acceptable range of accuracy.

11. The non-transitory program storage device of claim 10, wherein at least one optimization parameter related to the optimization process that is used to select the in-situ stress field parameters is tuned prior to recalculating the values for the in-situ stress field parameters relating to the in-situ stress field.

12. The non-transitory program storage device of claim 11, wherein verification and recalculation are repeated until the calculated values for the in-situ stress field parameters relating to the in-situ stress field are inside an acceptable range of accuracy.

13. The non-transitory program storage device of claim 1, wherein to generate at least one second image log based on the calculated values, the processor further comprises instructions stored thereon to cause the one or more processors to:

receive the calculated values for the in-situ stress field parameters relating to the in-situ stress field in the formation;

receive the one or more input parameters relating to the wellbore; and generate one or more synthetic image logs for the wellbore, wherein the one or more synthetic image logs are generated based on the calculated values for the in-situ stress field parameters relating to the in-situ stress field and the one or more input parameters.

14. The non-transitory program storage device of claim 13, wherein the instructions stored thereon further cause the one or more processors to generate one or more parameters relating to induced tensile fracture in the wellbore based on the one or more parameters relating to the in-situ stress field and the one or more input parameters.

15. The non-transitory program storage device of claim 14, wherein the one or more synthetic image logs are generated based on the one or more parameters relating to the induced tensile fracture in the wellbore.

16. The non-transitory program storage device of claim 14, wherein the one or more parameters relating to the induced tensile fracture in the wellbore comprise at least one of induced tensile fracture angle and induced tensile fracture orientation.

17. The non-transitory program storage device of claim 14, wherein utilizing the optimization process minimizing the difference between the calculated values and the observed values for the in-situ stress field parameters comprises performing a constrained non-linear optimization normalizing a difference between (i) the non-linear functions for the induced tensile fracture angle equation, the fracture initiation pressure equation, and the induced tensile fracture orientation equation and (ii) analytic models of the non-linear functions for the induced tensile fracture angle equation, the fracture initiation pressure equation, and the induced tensile fracture orientation equation constrained by a known parameter vector.

18. A method of improving recovery of formation fluid from a wellbore in a formation, the wellbore having one or more induced tensile fractures into the formation, the method comprising:

receiving at least one first image log for the wellbore generated by an image logging device imaging the wellbore in the formation;

receiving one or more input parameters relating to the wellbore;

determining, based on the at least one first image log, observed values for in-situ stress field parameters relating to a minimum horizontal stress, a maximum horizontal stress, and a maximum horizontal stress direction of an in-situ stress field in the formation having the one or more induced tensile fractures in the wellbore;

calculating, with the one or more input parameters and the one or more fracture parameters, calculated values for the in-situ stress field parameters relating to the minimum horizontal stress, the maximum horizontal stress, and the maximum horizontal stress direction of the in-situ stress field in the formation, wherein the calculation is done by utilizing an optimization process minimizing a difference between the calculated values and the observed values for the in-situ stress field parameters;

verifying the calculated values for the in-situ stress field parameters by generating at least one second image log based on the calculated values and comparing the at one received first image log to the at least one generated second image log; and indicating, based on the verified values for the in-situ stress field parameters, a step of stabilizing the wellbore, fracturing the wellbore, and/or producing from the wellbore.

19. The method of claim 18, wherein the in-situ stress field parameters relating to the one or more induced tensile fractures comprise an induced tensile fracture angle equation, a fracture initiation pressure equation, and an induced tensile fracture orientation equation, each of the equations being a non-linear function of the minimum horizontal stress, the maximum horizontal stress, and the maximum horizontal stress direction.

20. The method of claim 19, wherein utilizing the optimization process minimizing the difference between the calculated values and the observed values for the in-situ stress field parameters comprises performing a constrained non-linear optimization normalizing a difference between (i) the non-linear functions for the induced tensile fracture angle equation, the fracture initiation pressure equation, and the induced tensile fracture orientation equation and (ii) analytic models of the non-linear functions for the induced tensile fracture angle equation, the fracture initiation pressure equation, and the induced tensile fracture orientation equation constrained by a known parameter vector.

21. The method of claim 18, wherein the one or more input parameters relating to the wellbore comprise a type of faulting regime.

22. The method of claim 21, wherein the type of faulting regime comprises one of normal faulting, strike-slip faulting, and reverse faulting.

23. The method of claim 21, wherein the type of faulting regime selected provides an initial constraint range for the calculated values of the in-situ stress field parameters relating to the in-situ stress field.

24. The method of claim 18, wherein the one or more input parameters relating to the wellbore comprise a fracture initiation pressure.

25. The method of claim 18, wherein verifying the calculated values for the in-situ stress field parameters relating to the in-situ stress field by comparing the at one received first image log to the at least one generated second image log further comprises:

calculating at least one fracture initiation pressure based on the calculated values for the in-situ stress field parameters relating to the in-situ stress field;

calculating a value for an amount of variation between the at least one generated second image log and the at least one received first image log and the calculated fracture initiation pressure and a received fracture initiation pressure; and determining that the calculated values for the in-situ stress field parameters relating to the in-situ stress field are accurate based on the amount of variation.

26. The method of claim 25, further comprising recalculating values for the in-situ stress field parameters relating to the in-situ stress field in response to determining that the calculated values for the in-situ stress field parameters relating to the in-situ stress field are outside an acceptable range of accuracy.

27. The method of claim 26, wherein at least one optimization parameter relating to the optimization process used to select the in-situ stress field parameters is tuned prior to recalculating the values for the in-situ stress field parameters relating to the in-situ stress field.

28. The method of claim 27, wherein verification and recalculation are repeated until the calculated values for the in-situ stress field parameters relating to the in-situ stress field are inside an acceptable range of accuracy.

29. The method of claim 18, wherein the one or more input parameters relating to the wellbore comprise third parameters affecting near wellbore stress concentration.

30. The method of claim 18, wherein the optimization process comprises of a constrained non-linear optimization problem.

31. The method of claim 18, wherein generating the at least one second image log comprises:

receiving the calculated values for the in-situ stress field parameters relating to the in-situ stress field in the formation;

receiving the one or more input parameters relating to the wellbore; and generating one or more synthetic image logs for the wellbore, wherein the one or more synthetic image logs are generated based on the calculated values for the in-situ stress field parameters relating to the in-situ stress field and the one or more input parameters.

32. The method of claim 31, further comprising generating one or more parameters relating to induced tensile fracture in the wellbore based on the one or more parameters relating to the in-situ stress field and the one or more input parameters.

33. The method of claim 32, wherein the one or more synthetic image logs are generated based on the one or more parameters relating to induced tensile fracture in the wellbore.

34. The method of claim 32, wherein the one or more parameters relating to induced tensile fracture around the wellbore comprise at least one of induced tensile fracture angle and induced tensile fracture orientation.

35. The method of claim 18, wherein indicating, based on the calculated values for the in-situ stress field parameters, the step of stabilizing the wellbore, fracturing the wellbore, and/or producing from the wellbore comprises using the calculated values in: analyzing borehole stress, stability, and strengthening; identifying critically stressed fractures; modeling stressed induced anisotropy; or calculating stress variations between fracture stages along the wellbore.

36. The method of claim 18, wherein indicating, based on the calculated values for the in-situ stress field parameters, the step of stabilizing the wellbore, fracturing the wellbore, and/or producing from the wellbore comprises generating a continuous log of synthetic image logs using the calculated stress field to guide image log interpretation when the data quality is low.

37. A system for evaluating a wellbore in a formation, the wellbore having one or more induced tensile fractures into the formation, the system comprising:

an image logging device for generating at least one first image log for the wellbore;

a memory for storing the at least one first image log;

a display device; and a processor operatively coupled to the memory and the display device and adapted to execute program code stored in the memory to:

receive the at least one first image log for the wellbore in the formation;

receive one or more input parameters relating to the wellbore;

determine, based on the at least one first image log, observed values for in-situ stress field parameters relating to a minimum horizontal stress, a maximum horizontal stress, and a maximum horizontal stress direction of an in-situ stress field in the formation having the one or more induced tensile fractures in the wellbore;

calculate, with the one or more input parameters and the one or more fracture parameters, values for the in-situ stress field parameters relating to the minimum horizontal stress, the maximum horizontal stress, and the maximum horizontal stress direction of the in-situ stress field in the formation, wherein the calculation is done by utilizing an optimization process minimizing a difference between the calculated values and the observed values for the in-situ stress field parameters;

generate at least one second image log based on the calculated values and compare the at one received first image log to the at least one generated second image log to verify the calculated values for the in-situ stress field parameters; and indicate, based on the verified values for the in-situ stress field parameters, a step of stabilizing the wellbore, fracturing the wellbore, and/or producing from the wellbore.

38. The system of claim 37, wherein the in-situ stress field parameters relating to the one or more induced tensile fractures comprise an induced tensile fracture angle equation, a fracture initiation pressure equation, and an induced tensile fracture orientation equation, each of the equations being a non-linear function of the minimum horizontal stress, the maximum horizontal stress, and the maximum horizontal stress direction.

39. The system of claim 38, wherein utilizing the optimization process minimizing the difference between the calculated values and the observed values for the in-situ stress field parameters comprises performing a constrained non-linear optimization normalizing a difference between (i) the non-linear functions for the induced tensile fracture angle equation, the fracture initiation pressure equation, and the induced tensile fracture orientation equation and (ii) analytic models of the non-linear functions for the induced tensile fracture angle equation, the fracture initiation pressure equation, and the induced tensile fracture orientation equation constrained by a known parameter vector.

40. The system of claim 37, wherein the one or more input parameters relating to the wellbore comprise a type of faulting regime.

41. The system of claim 40, wherein the type of faulting regime comprises one of normal faulting, strike-slip faulting, and reverse faulting.

42. The system of claim 40, wherein the type of faulting regime selected provides an initial constraint range for the calculated values of the in-situ stress field parameters relating to the in-situ stress field.

43. The system of claim 37, wherein the one or more input parameters relating to the wellbore comprise a fracture initiation pressure.

44. The system of claim 37, wherein to verify the calculated values for parameters relating to the in-situ stress field, the processor is further adapted to execute program code stored in the memory to:

calculate at least one fracture initiation pressure based on the calculated values for the in-situ stress field parameters relating to the in-situ stress field;

calculate a value for an amount of variation between the generated image log and the received image log and the calculated fracture initiation pressure and a received fracture initiation pressure; and determine that the calculated values for the in-situ stress field parameters relating to the in-situ stress field are accurate based on the amount of variation.

45. The system of claim 44, wherein the processor is further adapted to execute program code stored in the memory to recalculate values for the in-situ stress field parameters relating to the in-situ stress field in response to a determination that the calculated values for the in-situ stress field parameters relating to the in-situ stress field are outside an acceptable range of accuracy.

46. The system of claim 45, wherein at least one third parameter relating to the optimization process used to select the second, in-situ stress field parameters is tuned prior to recalculating the values for the in-situ stress field parameters relating to the stress field.

47. The system of claim 46, wherein verification and recalculation are repeated until the calculated values for the in-situ stress field parameters relating to the in-situ stress field are inside an acceptable range of accuracy.

48. The system of claim 37, wherein the one or more input parameters relating to the wellbore comprise third parameters affecting near wellbore stress concentration.

49. The system of claim 37, wherein the optimization process comprises of a constrained non-linear optimization problem.

50. The system of claim 37, wherein to generate at least one second image log based on the calculated values, the processor operatively coupled to the memory and the display device and adapted to execute program code stored in the memory to:

receive the calculated values for the in-situ stress field parameters relating to the in-situ stress field in the formation;

receive the one or more input parameters relating to the wellbore; and generate one or more synthetic image logs for the wellbore, wherein the one or more synthetic image logs are generated based on the calculated values for the in-situ stress field parameters relating to the in-situ stress field and the one or more input parameters.

51. The system of claim 50, wherein the processor is further adapted to execute program code stored in the memory to generate one or more parameters relating to induced tensile fracture in the wellbore based on the one or more parameters relating to the in-situ stress field and the one or more input parameters.

52. The system of claim 51, wherein the one or more synthetic image logs are generated based on the one or more parameters relating to induced tensile fracture in the wellbore.

53. The system of claim 52, wherein the one or more parameters relating to induced tensile fracture in the wellbore comprise at least one of induced tensile fracture angle and induced tensile fracture orientation.

* * * * *